US005169420A

United States Patent [19]

Chen

[11] Patent Number: 5,169,420

[45] Date of Patent: Dec. 8, 1992

[54] INDUSTRIAL DUST COLLECTOR

[76] Inventor: Peter Chen, No. 9, Alley 7, Jung-Ho Lane, Pei-Tuen Area, Taichung City, Taiwan

[21] Appl. No.: 818,201

[22] Filed: Jan. 8, 1992

[51] Int. Cl.[5] ..... B01D 50/00; B01D 46/02

[52] U.S. Cl. ..... 55/315; 55/429; 55/471; 55/482; 55/337; 55/DIG. 3

[58] Field of Search ..... 55/337, 429, 471, 473, 55/DIG. 3, 315, 350, 482

[56] References Cited

U.S. PATENT DOCUMENTS 3,308,609 3/1967 McColloch et al. ..... 55/337 X
3,320,727 5/1967 Farley et al. ..... 55/DIG. 3 X
3,870,486 3/1975 Eriksson et al. ..... 55/DIG. 3 X
3,895,929 7/1975 Jysky et al. ..... 55/429 X
4,133,658 1/1979 Callewyn ..... 55/DIG. 3 X
4,900,339 2/1990 Ward et al. ..... 55/337 X
4,993,107 2/1991 Zoni ..... 55/429 X

*Primary Examiner*—Charles Hart
*Attorney, Agent, or Firm*—Browdy and Neimark

[57] ABSTRACT

An industrial dust collector comprises mainly a base, a guide box, a motor, a suction fan, a suction hose, a filtration bag, a dust bag, and a pre-filtering means disposed between the guide box and the suction hose so as to filter out the objects considerably greater in size and weight than the dust in order to prevent such objects from damaging the suction fan and the dust bag.

14 Claims, 4 Drawing Sheets

INDUSTRIAL DUST COLLECTOR

BACKGROUND OF THE INVENTION

The present invention relates to an industrial dust collector, and more particularly to an industrial dust collector having a prefiltering means.

As shown in FIG. 1, an industrial dust collector 10 of the prior art comprises mainly a base 11, support frames 12 arranged at upper portions of both ends of base 11, a guide box 13 disposed over the support frame 12, a motor 15, a suction hose 14, a filtering bag 18, a dust collecting bag 17, and a fan 16 driven by the motor 15.

The working of the prior art dust collector 10 is accomplished by the fan 16, which is driven by the motor 15 to bring about a stream of suction inside the suction hose 14 to draw the dust into the end of the suction hose 14 and then into the guide box 13, through which the air stream is released via the filtering bag 18 while the dust is collected in the dust bag 17.

Such dust collector 10 of the prior art described above is defective in design in that it is not provided with a filtering means between the suction hose 14 and the guide box 13. As a result, the sharp objects, such as nails, iron dusts, wood pieces, may be sucked into the guide box 13 in which the fan 16 is subjected to colliding abrasively with them. Furthermore, the dust bag 17 can be easily pierced by the sharp objects collected therein.

SUMMARY OF THE INVENTION

It is therefore the primary objective of the present invention to provide an industrial dust collector with a pre-filtering means intended to filter out the sharp objects so as to protect the fan and the dust bag of the dust collector.

In keeping with the principles of the present invention, the primary objective of the present invention is accomplished by an industrial dust collector provided with a pre-filtering means disposed between the guide box and the suction hose of the dust collector. In addition, the prefiltering means so provided is in communication with both guide box and suction hose so as to allow the objects considerably greater in size than dusts to be filtered out and deposited in the pre-filtering means. As a result, the air stream entering the guide box from the suction hose is free from any sharp object capable of doing damage to both suction fan and dust bag of the dust collector.

In addition, the effectiveness of industrial dust collector of the present invention is further enhanced by the pre-filtering means, which is arranged in such a way that it is spaced apart respectively a predetermined distance from the guide box and the suction hose so as to permit the objects carried by the air stream to fall in the space located therebetween in order to prevent the objects from being carried by the air stream all the way from the suction hose through the pre-filtering means and the guide box.

DETAILED DESCRIPTION OF THE PREFERRED EMBODIMENTS

Figure 1:
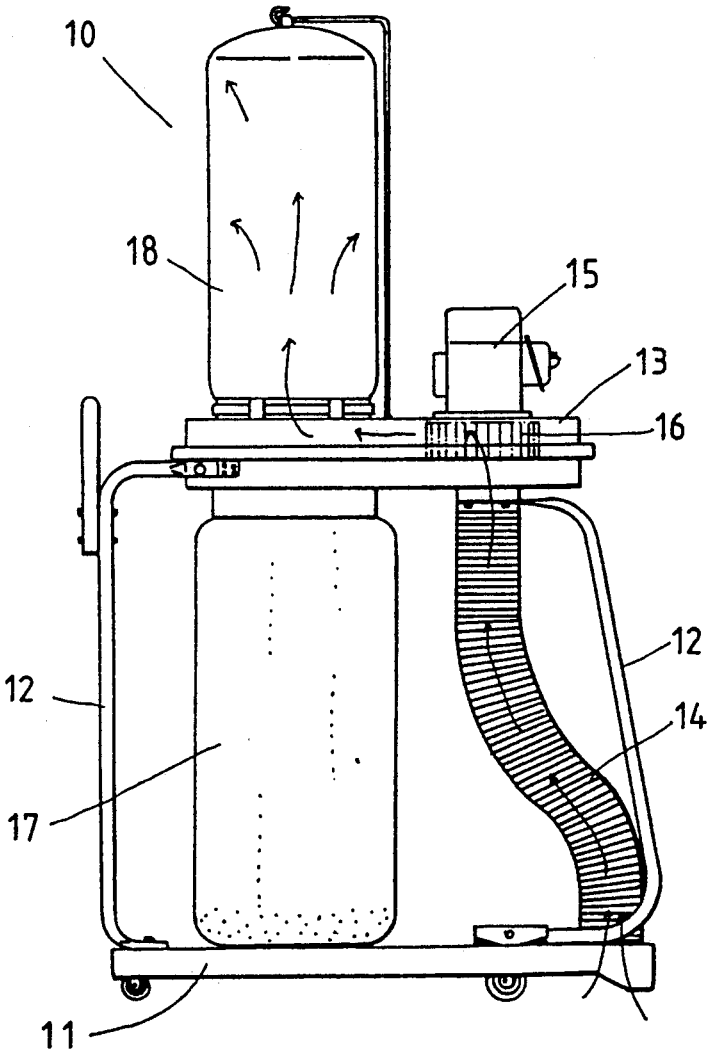
FIG. 1 PRIOR ART
FIG. 1 shows a three-dimensional view of an industrial dust collector of the prior art.
Figure 2:
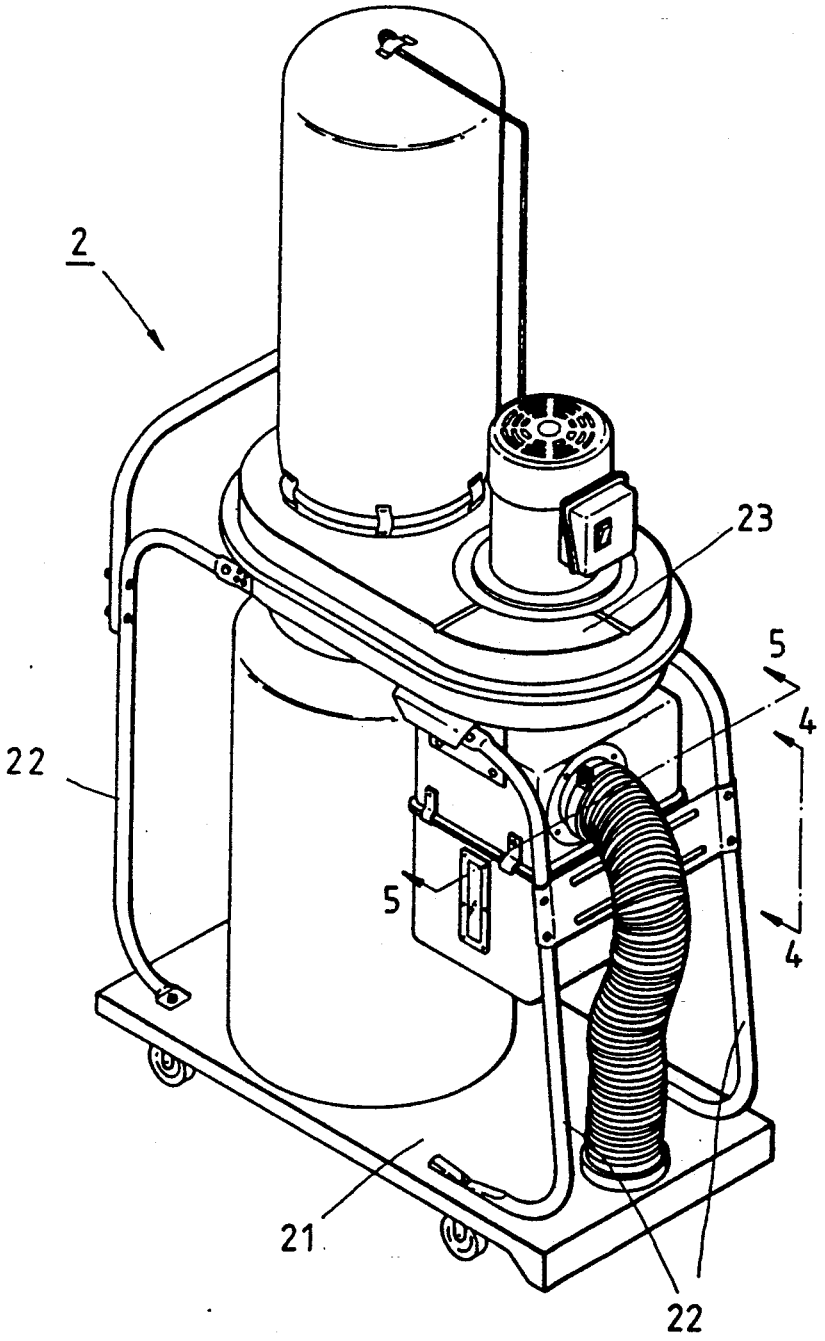
FIG. 2 shows a three-dimensional view of an industrial dust collector of the present invention.
Figure 3:
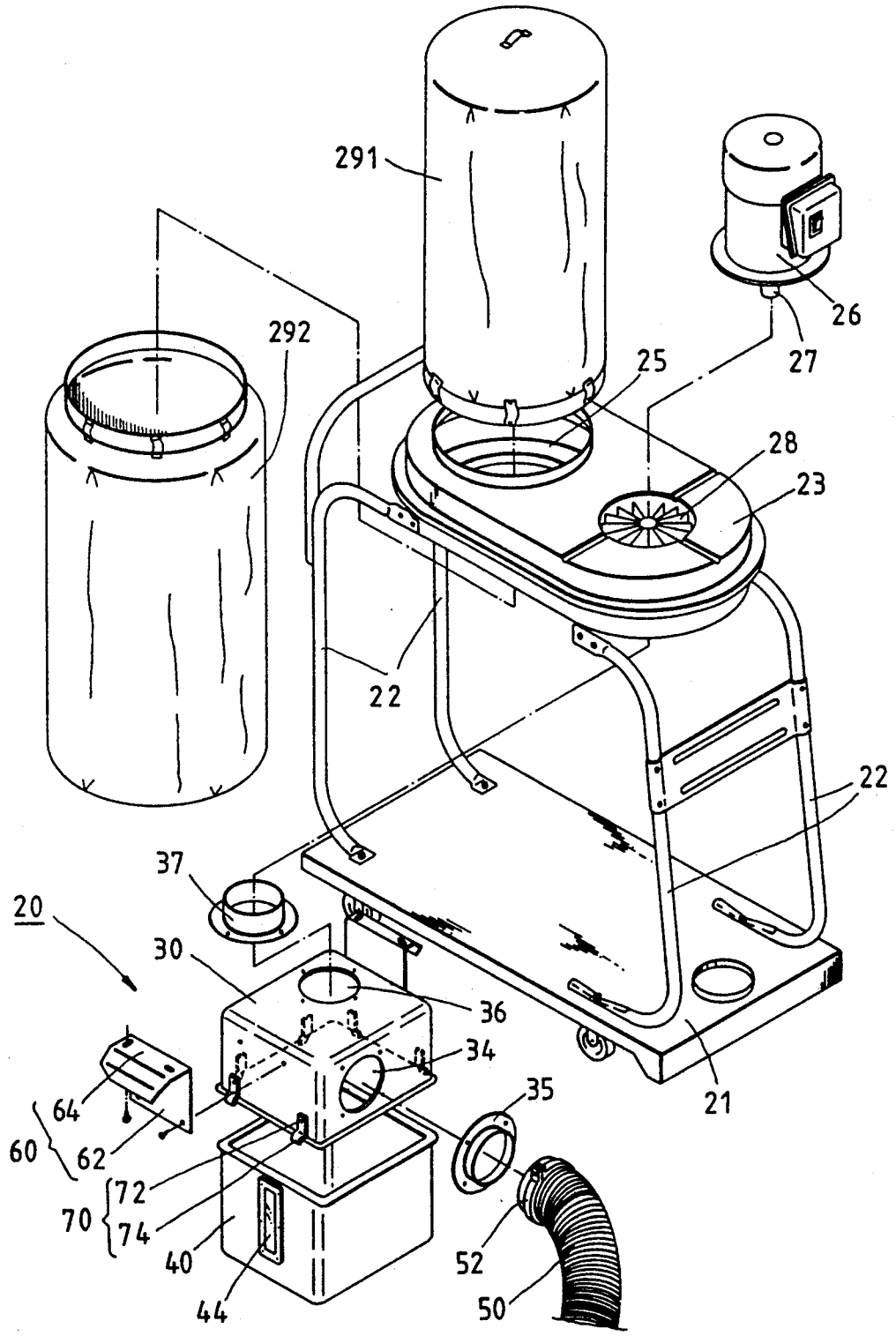
FIG. 3 shows an exploded view of an industrial dust collector of the present invention.
Figure 4:
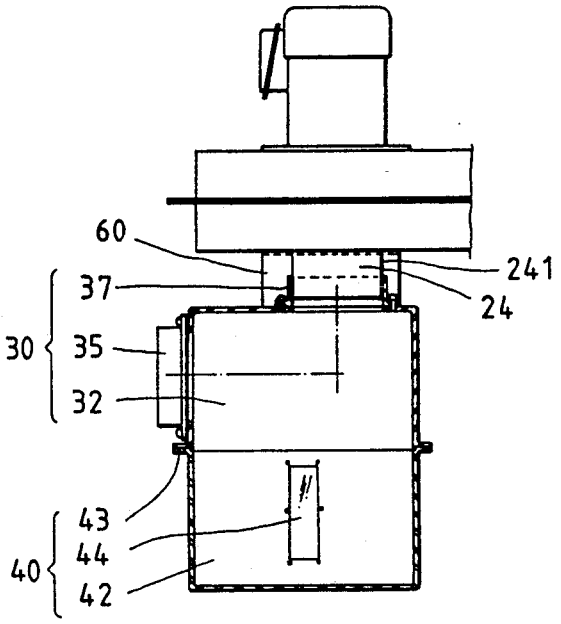
FIG. 4 shows a sectional view of the first preferred embodiment of the present invention taken along the line 4—4 as shown in FIG. 2.
Figure 5:
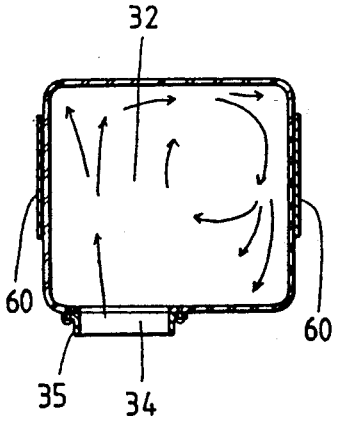
FIG. 5 shows a sectional view of the first preferred embodiment of the present invention taken along the line 5—5 as shown in FIG. 2.

Referring to FIGS. 2-5, the industrial dust collector 2 of the present invention is shown comprising a base 21, two pairs of support frames 22 attached respectively at the bottom thereof to the base 21, a guide box 23 fastened to the top ends of the support frames 22 and provided with an air inlet 24 having a circular flange 241 and further provided with a pair of air outlets 25 arranged oppositely, a motor 26 fastened to the upper portion of the guide box 23 and provided with a driving shaft 27, a suction fan 28 fastened to the driving shaft 27, a pervious filtration bag 291 fitted to the air outlet 25, and a dust bag 292 fitted to the air outlet 25 to collect the dust.

The industrial dust collector 2 of the present invention further comprises a pre-filtering device 20 provided with an upper housing 30, a lower housing 40, a suction hose 50, a pair of locking pieces 60, and three pairs of hooking pieces 70.

The upper housing 30 is of rectangular construction and is provided with an upper container 32 having an opening facing downwardly, and with a dust collecting port 34, and further with an air exit 36. The dust collecting port 34 and the air exit 36 are respectively provided at the peripheries thereof with a first circular sleeve 35 and a second circular sleeve 37. The dust collecting port 34 and the air exit 36 are arranged in such manners that they are axially perpendicular to each other and that they are spaced apart at a predetermined interval.

The lower housing 40 is rectangular in shape corresponding to that of the upper housing 30 and is composed of a lower container 42 having an opening facing upwardly, and of a transparent window 44, and further of a flange 43 disposed at the outer edge of the opening of the lower container 42.

The suction hose 50 has one end with an inner diameter corresponding to the outer diameter of the first circular sleeve 35 of the upper housing 30 so as to be fitted over the first circular sleeve 35 and to be fastened to the first circular sleeve 35 by means of a locking sleeve 52.

Each of the two locking pieces 60 is provided with a flat portion 62, which is fastened to the external side of the upper housing 30, and with a curved portion 64 fastened to the lower side of the guide box 24.

Each of the locking pieces 70 is composed of a body portion 72 fastened to the opening end of the upper housing 30 and of a hook portion 74 of a bowlike curved construction with a recess facing inwardly.

In the process of assembling the components described above, the second circular sleeve 37 of the upper housing 30 is fitted over the circular flange 241 of the air inlet 24 located at the lower end of the guide box 23 and is fastened to the circular flange 241 by means of a locking piece 60. The flange 43 of the lower housing 40 is inserted into the hook portion 74 of the hooking pieces 70.

The operation of the industrial dust collector 2 of the present invention is initiated by the onset of a stream of suction generated by means of rapid rotation of the suction fan 28 driven by the motor 26. The air outside the dust collector 2 is drawn into the suction hose 50 and then into the upper and the lower containers 32 and 42. Thereafter, the air stream flows out of the air exit 36 via the dust collecting port 34 in view of the facts that the dust collecting port 34 of the upper housing 30 and the air exit 36 of the upper housing 30 are axially perpendicular to each other and that the dust collecting port 34 and the air exit 36 are spaced apart. The air stream is subsequently guided into the guide box 23 via the air inlet 24. At the time when such process is under way, an eddy of air is brought about in the upper container 32, thereby resulting in the larger and the heavier objects carried in the air stream to fall into the lower housing 40 by virtue of the law of gravity and of the fact that these objects are subjected to colliding with the inner wall of the upper housing 30 so as to lose their momentum. The industrial dust collector 2 of the present invention is provided with a window 44 for the convenience of the operator to be aware of the quantity of objects deposited in the lower housing 40.

Figure 6:
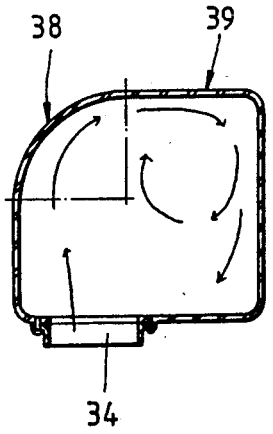
FIG. 6 shows a sectional view of the second preferred embodiment of the present invention taken along the line 5—5 as shown in FIG. 2.
Figure 7:
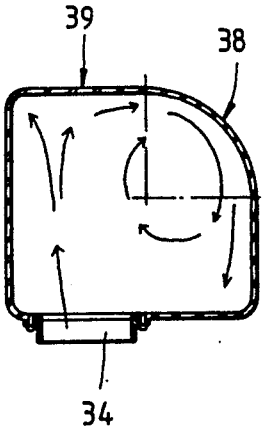
FIG. 7 shows a sectional view of the third preferred embodiment of the present invention taken along the line 5—5 as shown in FIG. 2.

Now referring to FIGS. 6 and 7, the upper housing 30 is provided therein with a curved surface 38 opposite to the dust collecting port 34, and with a plane surface 39. The curved surface 38 is designed in such a manner that its axial center is parallel to the axis of the air exit 36 so as to permit the air current, which has entered the upper container 32, to flow along the curved surface 38 to enter the guide box 23 via the air exit 36. Therefore, the objects are subjected to colliding with the bordering portion of the curved surface 38 and the plane surface 39 so as to fall into the lower container 42.

The embodiments of the present invention described above are to be considered in all respects as merely illustrations of principles of the present invention. Accordingly, the present invention is to be limited only by the scope of the hereinafter appended claims.

What is claimed is:

1. An industrial dust collector comprising:

(a) a base;

(b) a guide box of hollow construction disposed on said base and provided with an air inlet, an air outlet, and a dust collecting port, said air inlet and said dust collecting port being arranged opposite to each other;

(c) a motor fastened to said guide box and provided with a driving shaft extending into said guide box;

(d) a suction fan disposed in said guide box and fastened to said driving shaft;

(e) a filtration bag fastened at the opening thereof to said air outlet of said guide box;

(f) a dust bag fastened at the opening thereof to said dust collecting port of said guide box and located correspondingly to said filtration bag; and (g) pre-filtering means disposed between said air inlet and a suction hose connected to a dust collecting port of an upper housing of said pre-filtering means to prevent objects greater in size and weight than dust from being drawn into said guide box.

2. An industrial dust collector according to claim 1, wherein said pre-filtering means comprising an upper housing has an opening which joins with an opening of a lower housing of said pre-filtering device.

3. An industrial dust collector according to claim 2, wherein said pre-filtering means comprises an air exit and an air inlet, said air exit being in communication with said air inlet of said guide box.

4. An industrial dust collector according to claim 3, wherein said air exit of said pre-filtering means is axially spaced apart with said air inlet of said pre-filtering means.

5. An industrial dust collector according to claim 3, wherein said air exit and said air inlet of said pre-filtering means are axially perpendicular to each other.

6. An industrial dust collector according to claim 3, wherein said pre-filtering means comprises a curved surface of a length disposed on an inner edge thereof.

7. An industrial dust collector according to claim 3, wherein said pre-filtering means comprises a curved surface of a length and a plane surface of a length disposed respectively on an inner edge thereof.

8. An industrial dust collector according to claim 7, wherein said curved surface is axially opposite to said air inlet of said pre-filtering means.

9. An industrial dust collector according to claim 7, wherein said plane surface is axially opposite to said air inlet of said pre-filtering means.

10. An industrial dust collector according to claim 7, wherein said curved surface is axially parallel to said air exit of said pre-filtering.

11. An industrial dust collector according to claim 1, wherein said pre-filtering means comprises a transparent window on a periphery thereof.

12. An industrial dust collector according to claim 1, further comprising a plurality of locking elements having a first locking portion fastened to said guide box and having a second locking portion fastened to said pre-filtering means.

13. An industrial dust collector according to claim 2, wherein said upper housing comprises at the opening end thereof a first connection means, and wherein said lower housing comprises at the opening end thereof a second connection means joined with said first connection means of said upper housing.

14. An industrial dust collector according to claim 13, wherein said first connection means comprises a plurality of locking pieces having a locking end fastened to said upper housing and having a curved hooking end extending downwardly, and wherein said second connection means is disposed on the flange located at the outer edge of said opening end of said lower housing to permit said flange to set across an inner side of said hooking end.

* * * * *